US009855995B2

(12) United States Patent
Fafard et al.

(10) Patent No.: US 9,855,995 B2
(45) Date of Patent: Jan. 2, 2018

(54) WAKE SHAPING DEVICE AND SYSTEM

(71) Applicant: Chaparral Boats, Inc., Nashville, GA (US)

(72) Inventors: Michael J. Fafard, Nashville, GA (US); William S. Pegg, Nashville, GA (US); Michael Anthony Werle, Nashville, GA (US)

(73) Assignee: Chaparral Boats, Inc., Nashville, GA (US)

( * ) Notice: Subject to any disclaimer, the term of this patent is extended or adjusted under 35 U.S.C. 154(b) by 80 days.

(21) Appl. No.: 14/818,069

(22) Filed: Aug. 4, 2015

(65) Prior Publication Data

US 2016/0244126 A1 Aug. 25, 2016

Related U.S. Application Data

(60) Provisional application No. 62/118,237, filed on Feb. 19, 2015.

(51) Int. Cl.

| | |
|---|---|
| ***B63B 1/32*** | (2006.01) |
| ***B63B 29/00*** | (2006.01) |
| ***B63B 35/73*** | (2006.01) |
| ***B63B 29/02*** | (2006.01) |
| *B63B 35/85* | (2006.01) |

(52) U.S. Cl.

CPC ..... *B63B 1/32* (2013.01); *B63B 29/00* (2013.01); *B63B 29/02* (2013.01); *B63B 35/73* (2013.01); *B63B 2029/022* (2013.01); *B63B 2035/855* (2013.01)

(58) Field of Classification Search

CPC B63B 1/32; B63B 29/00; B63B 29/02; B63B 2029/022; B63B 35/73; B63B 35/85; B63B 2035/855

USPC ..... 114/271, 284, 288–290, 343; D12/317

See application file for complete search history.

(56) References Cited

U.S. PATENT DOCUMENTS

| | | | | |
|---|---|---|---|---|
| 2,950,699 | A * | 8/1960 | Ogden | B63B 35/73 114/283 |
| 4,553,945 | A * | 11/1985 | Foster | B63H 5/16 114/162 |
| 4,741,714 | A * | 5/1988 | Uchida | B63H 20/34 440/66 |
| 5,224,436 | A * | 7/1993 | Stricker | B63B 1/04 114/271 |
| 5,293,832 | A * | 3/1994 | Potter, Jr. | B63H 20/06 114/343 |
| 5,329,074 | A * | 7/1994 | Alexander | B63H 20/245 181/235 |
| 5,549,071 | A | 8/1996 | Pigeon | |
| 6,105,527 | A | 8/2000 | Lochtefeld | |

(Continued)

*Primary Examiner* — Ajay Vasudeva

(74) *Attorney, Agent, or Firm* — Fish & Richardson P.C.

(57) ABSTRACT

Boats can be adapted to generate a wake that is well-suited for the sport of wake surfing. For example, boats can include an aft platform with a contoured underside that contacts water to generate such a wake for wake surfing. In some embodiments, the contoured underside of the platform includes dual opposing wake-shaping surfaces that shape the water flowing aft from the boat hull to create a wake shape that is well-suited for wake surfing. The aft platforms can be integrally manufactured as an extension to the hull or deck of a new boat, or manufactured separately and subsequently affixed to a previously manufactured boat.

20 Claims, 8 Drawing Sheets

(56) References Cited

U.S. PATENT DOCUMENTS

| | | | | |
|---|---|---|---|---|
| 6,260,503 | B1 * | 7/2001 | Allison | B63B 1/24 114/274 |
| 7,140,318 | B1 | 11/2006 | Gasper | |
| 7,252,047 | B1 * | 8/2007 | Baucom, Jr. | A63B 69/187 114/284 |
| 7,905,193 | B2 * | 3/2011 | Beamer | B63B 39/061 114/285 |
| 8,459,198 | B2 * | 6/2013 | Kilgore | B63B 1/08 114/271 |
| 8,578,873 | B2 | 11/2013 | Gasper | |
| 8,590,475 | B2 | 11/2013 | Viviani | |
| 9,199,695 | B2 * | 12/2015 | Gasper | B63B 1/28 |
| 9,394,032 | B1 * | 7/2016 | Pigeon | B63B 1/08 |
| 9,517,824 | B1 * | 12/2016 | Rondeau | B63H 20/06 |

* cited by examiner

WAKE SHAPING DEVICE AND SYSTEM

CROSS-REFERENCE TO RELATED APPLICATIONS

This application claims the benefit of U.S. Provisional Application Ser. No. 62/118,237, filed Feb. 19, 2015. The disclosure of the prior application is considered part of (and is incorporated by reference in) the disclosure of this application.

BACKGROUND

This document relates to devices and systems for boating. For example, this document relates to boats and boat platforms that facilitate the generation of a wake that is suitable for wake surfing.

Wake surfing is a watersport in which a person surfs on a powerboat's wake without being directly pulled by the boat. In most cases, the wake surfer initially gets into the surfing position relative to the boat's wake by being pulled by a towrope. When the wake surfer is in a comfortable surfing position, the surfer can drop the rope, and ride the boat's wake in a fashion reminiscent of ocean surfing.

SUMMARY

Some boats, as described herein, can be adapted to generate a wake that is well-suited for the sport of wake surfing. For example, boats can include an aft platform with a contoured underside that contacts water to generate such a wake for wake surfing. In some embodiments, the contoured underside of the platform includes dual opposing wake-shaping surfaces that shape the water flowing aft from the boat hull to create a wake shape that is well-suited for wake surfing. In some implementations, the aft platforms are integrally manufactured as an extension to the hull or deck of a new boat. In some implementations, the aft platforms are manufactured individually, and subsequently affixed to a previously manufactured boat.

In one implementation, a boat platform provided herein includes a water contacting surface having a concave shape between a port side and a starboard side of the boat platform, and a boat engaging side that is configured for connection to an aft portion of a boat.

Such a boat platform may optionally include one or more of the following features. The water contacting surface may comprise a starboard-side wake-shaping surface and a port-side wake-shaping surface. The starboard-side wake-shaping surface and the port-side wake-shaping surface may collectively define the concave shape. In some embodiments, the starboard-side wake-shaping surface and the port-side wake-shaping surface are generally symmetric in relation to each other about a vertical plane that bisects the boat platform. Optionally, the starboard-side wake-shaping surface and the port-side wake-shaping surface may each comprise generally planar surfaces. In particular embodiments, the starboard-side wake-shaping surface and the port-side wake-shaping surface each comprise generally non-planar contoured surfaces.

In various embodiments of the boat platform, at least a portion of the water contacting surface slopes downward in a direction from the boat engaging side to an opposite side of the boat platform. The water contacting surface may comprise a starboard-side wake-shaping surface and a port-side wake-shaping surface. In some embodiments, each of the starboard-side wake-shaping surface and the port-side wake-shaping surface may define the downward slope of the water contacting surface. Optionally, a profile of the concave shape or a rate of the downward slope of at least a portion of the water contacting surface may be selectively adjustable. The boat platform may be configured to be bolted onto the aft portion of a boat or integrated into a hull and/or deck of the boat. In some embodiments, the boat platform is configured to be molded onto the aft portion of a boat.

In another implementation, a boat adapted to facilitate wakesurfing behind the boat includes a hull and a boat platform extending from an aft portion of the hull. The boat platform includes a water contacting surface. At least a portion the water contacting surface has a concave shape between a port side and a starboard side of the boat platform.

Such a boat adapted to facilitate wakesurfing may optionally include one or more of the following features. The boat platform may be integrally formed with the hull. In some embodiments, the boat includes a deck attached to the hull, and the boat platform is integrally formed with the deck. Optionally, the boat platform may be formed separately from the hull and the deck and subsequently affixed to the aft portion of the boat. In particular embodiments, at least a portion of the water contacting surface slopes downward in a direction from the aft portion of the hull to an opposite side of the boat platform.

In another implementation, a method of constructing a wakesurfing boat platform configured for attachment to a boat is provided herein. The method includes forming a water contacting surface having a concave shape between a port side and a starboard side of the boat platform, and forming a boat engaging side that is configured for attachment to an aft portion of the boat.

Such a method of constructing a wakesurfing boat platform configured for attachment to a boat may optionally include one or more of the following features. The water contacting surface may slope downward in a direction from the boat engaging side to an opposite side of the boat platform. The method may also include forming a top deck portion configured for supporting a human. In some embodiments, the boat platform is configured to be bolted onto an aft portion of the boat. In various embodiments, the boat platform comprises fiberglass.

Particular embodiments of the subject matter described in this document can be implemented to realize one or more of the following advantages. First, in some implementations the aft boat platforms described herein can be advantageously used to create a boat wake shape that is well-suited for wake surfing.

Second, some implementations of the boat platforms can be advantageously used in conjunction with virtually any type of sport boat, such as jet boats, sterndrive boats, inboard boats, and outboard boats to create a wake shape that enhances the wake surfing experience relative to boats that do not include the disclosed boat platforms.

Third, in some implementations the boat platforms described herein can be integrally formed with a boat during the manufacturing process of the boat. Alternatively, in some implementations the boat platforms described herein can be individually made and advantageously attached to an aft portion of a previously existing boat. Hence, a boat owner may be able to purchase one of the boat platforms described herein, and add it onto the previously existing boat to adapt the boat for enhanced wake surfing use.

Fourth, the boat platforms described herein shape the wake essentially by dragging the underside of the platform in the water when the boat is not on plane (as used herein, the term "on plane" refers to a watercraft's mode of operation in which its weight is predominantly supported by hydrodynamic lift, rather than hydrostatic lift or buoyancy). When the boat is sped up, such that the boat is on plane, the boat platform advantageously no longer drags in the water. Hence, the boat's top speed and fuel economy are not detrimentally affected by the presence of the boat platforms described herein when operated at speeds higher than those typically used for wake surfing.

Fifth, in some implementations the boat platforms described herein can be used in conjunction with a boat's ballast system. Advantageously, the ballast system can be used to further enhance the wake shaping characteristics of the boat platform.

Sixth, in some implementations the boat platforms described herein can increase the overall deck space of a sport boat to which the boat platform is attached. Increasing the deck space may lead to greater user enjoyment and enhanced safety of the boat.

Although methods and materials similar or equivalent to those described herein can be used to practice the invention, suitable methods and materials are described herein. All publications, patent applications, patents, and other references mentioned herein are incorporated by reference in their entirety. In case of conflict, the present specification, including definitions, will control. In addition, the materials, methods, and examples are illustrative only and not intended to be limiting.

The details of one or more embodiments of the invention are set forth in the accompanying drawings and the description herein. Other features, objects, and advantages of the invention will be apparent from the description and drawings, and from the claims.

DESCRIPTION OF THE DRAWINGS

Like reference numbers represent corresponding parts throughout.

DETAILED DESCRIPTION

This document provides devices and systems for boating. For example, this document provides boats and boat wake surfing platforms that generate a wake that is suitable for wake surfing.

Figure 1:
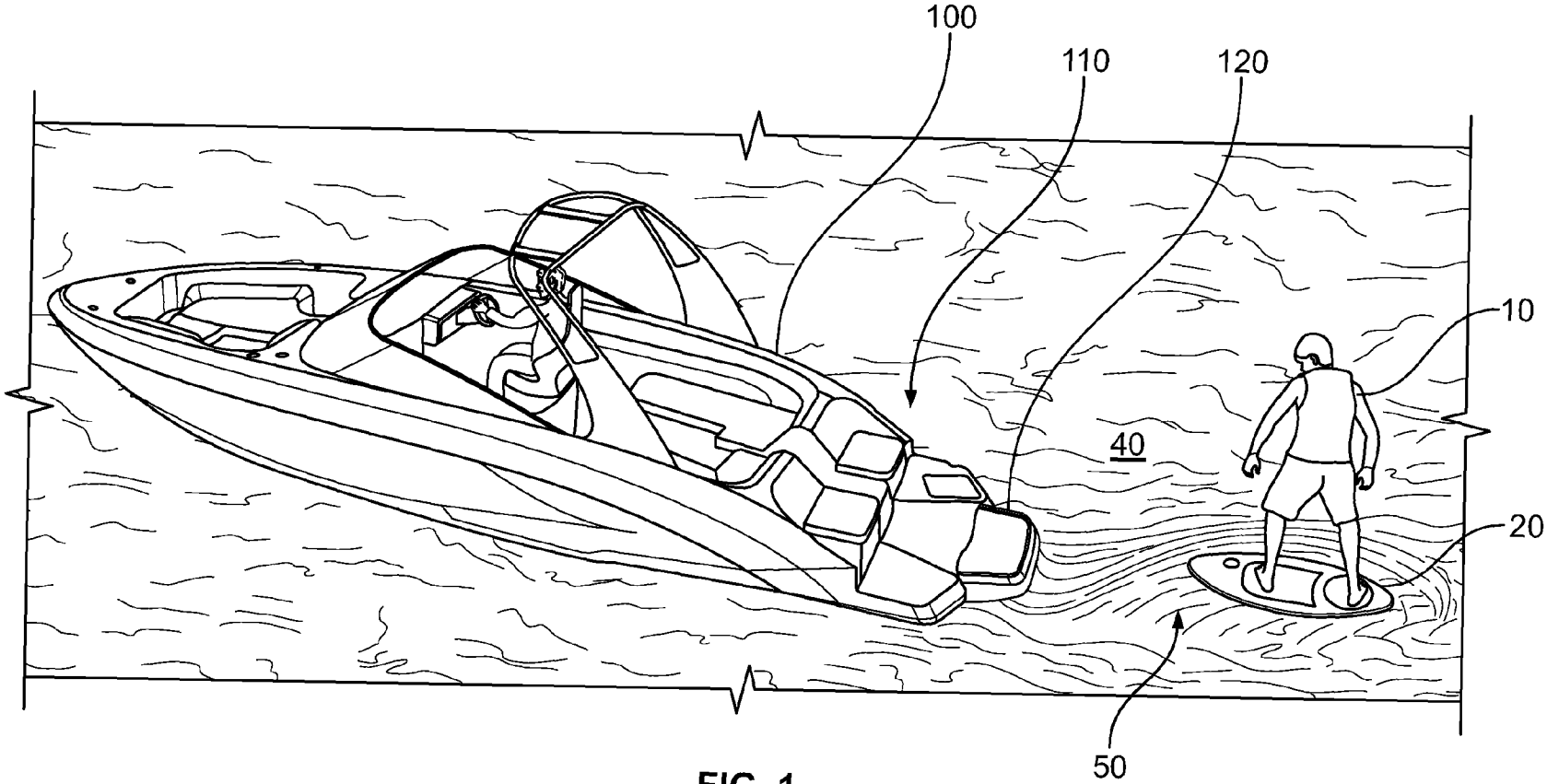
FIG. 1 is a perspective view of a wake surfer shown wake surfing behind a boat that includes an aft wake surfing platform in accordance with some embodiments.

Referring to FIG. 1, a wake surfer 10 can wake surf behind a boat 100 that includes an example wake surfing platform 120. The wake surfer 100 uses a surfboard 20 on a wake 50 that is generated by the boat 100. The wake surfing platform 120 (which may also be referred to herein as an "aerial surf platform" or simply as a "boat platform") extends from an aft portion 110 of the boat 100 and makes contact with the water 40 when the boat 100 is not on plane.

To attain the depicted wake surfing arrangement, typically the boat 100 initially pulls the wake surfer 10 using a tow rope, and accelerates at a moderate pace until a target speed is reached. The target speed is usually somewhere between 9 to 14 miles per hour, but the exact speed is usually determined (at least in part) by the desired shape, pitch, and length of the wake 50. Once the target speed is reached, the surfer 10 modulates the fore and aft pressure exerted on the surfboard 20 to find the "sweet spot" in the wake 50 where the rope goes slack and is no longer needed. At that juncture, the wake surfer 10 can toss the rope aside (or into the boat 100) and surf on the wake 50 as shown.

As described further below, the wake surfing platform 120 can at least partially shape the wake 50 generated by the boat 100 such that the wake 50 well-suited for wake surfing. In some implementations, the wake surfing platform 120 shapes water 40 emerging from the propulsion pump (or another type of propulsion device) of the boat 100 into a desired shape.

The wake surfing platform 120 can be attached to or formed on a bottom of an aft deck and/or a rear end of a hull of the boat 100. In some implementations, the wake surfing platform 120 is formed and configured to be subsequently affixed to a previously manufactured boat 100. In some implementations, the wake surfing platform 120 is formed during the manufacturing of the boat 100 as an integral portion of the boat 100.

As described further below, the shape of the underside water contacting surface of the wake surfing platform 120 can be curved or concaved, and ends of the curved wake surfing platform 120 can protrude below the bottom of the aft deck of the boat 100. In some implementations, the wake surfing platform 120 can be made of fiberglass or another appropriate material such as, but not limited to, aluminum, stainless steel, graphite, and the like, and combinations thereof.

Figure 2:
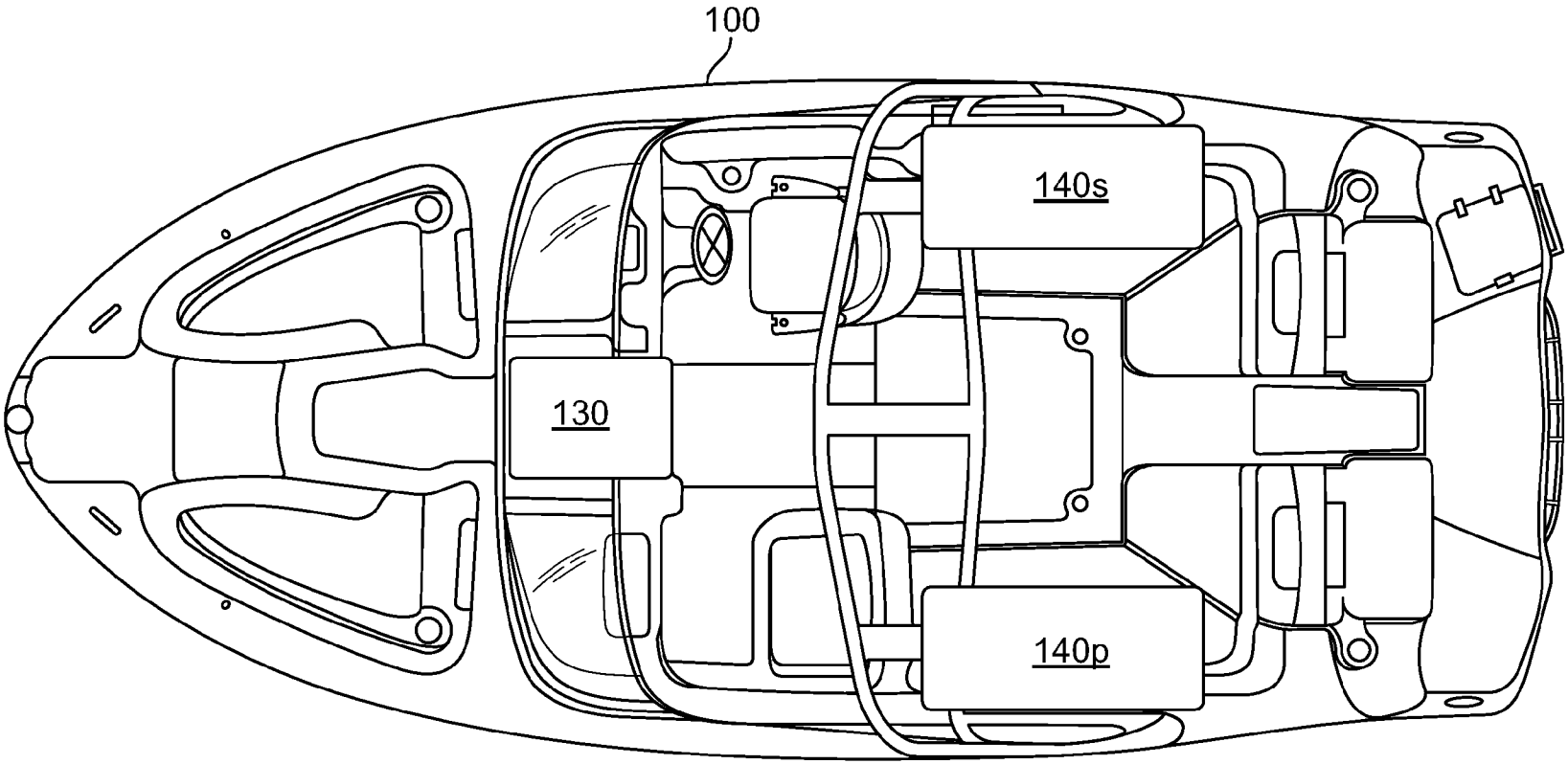
FIG. 2 is a plan view of an example sport boat with a ballast system.

Referring to FIG. 2, in some implementations the boat 100 can include a ballast system that includes one or more tanks 130, 140*s*, and 140*p*. Such a ballast system can be used to increase the weight of the boat 100, thereby facilitating the generation of a larger wake by the boat 100. In addition, in some implementations of the depicted ballast system, a particular side of the boat 100 (starboard or port) can be selectively weighted more heavily than the other side of the boat 100. That technique can be used to generate a larger and/or more desirably shaped wake (e.g., on the heavier side of the boat 100).

The tanks 130, 140*s*, and 140*p* can be configured to hold a substance, such as a liquid. The amount of liquid (or another substance) that is placed into one or more of the tanks 130, 140*s*, and 140*p* can adjust the weight distribution of the boat 100. In some implementations, two or more tanks 140*s* and 140*p* are located under aft seats (or otherwise in an aft portion of the boat 100), and an additional tank 130 (or multiple tanks) can be located closer to the bow than the aft seat tanks 140*s* and 140*p*.

In some implementations, the tanks 130, 140*s*, and 140*p* can be plumbed with one or more reversible pumps to facilitate filling and emptying of the tanks 130, 140*s*, and 140*p* using the pumps to draw water from the water in which the boat is placed. Example total loaded weights of the tanks 130, 140*s*, and 140*p* can be 250 pounds, 550 pounds, and 550 pounds respectively. The total loaded weight of each tank 130, 140*s*, and 140*p* can vary based on its size. In some implementations, filling the tanks 130, 140*s*, and 140*p* with water (or another substance) can enhance the creation and/or shape of a surf wake behind the boat 100. The weights provided above are for example purposes only, and other weights can be used (e.g., by using larger or smaller tanks).

Referring to FIGS. 3-7, in some implementations the wake surfing platform 120 includes a water contacting surface 122 on an underside of the wake surfing platform 120. The water contacting surface 122 as a whole is generally non-planer (e.g., curved or otherwise varying between sides of the water contacting surface). The non-planar shape of the water contacting surface 122 changes the shape of the boat wake (e.g., the wake that the boat 100 would create without the wake surfing platform 120) so that the wake is well-suited for wake surfing (e.g., larger, steeper, taller, and/or smoother, and the like).

Figure 4:
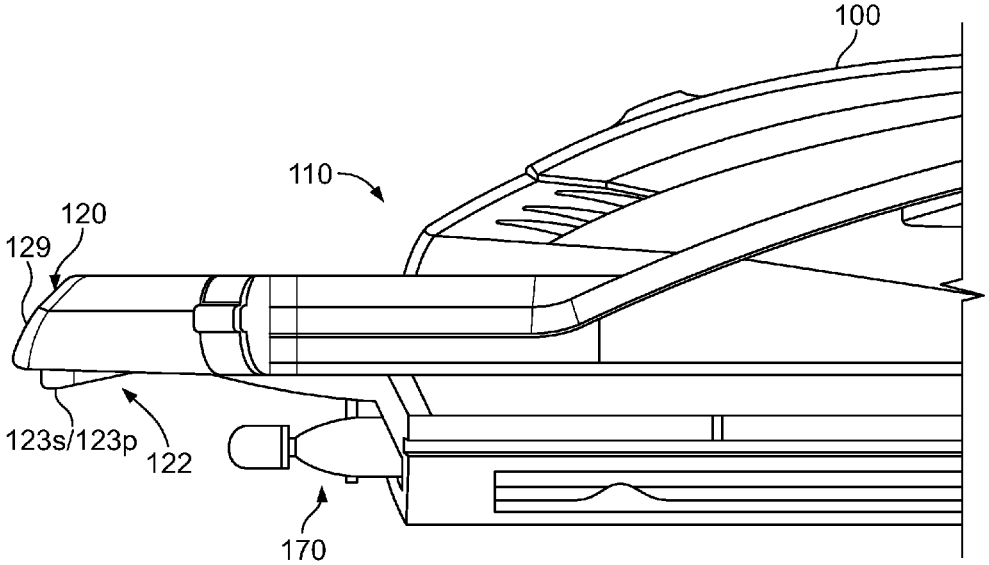
FIG. 4 is a partial side view of the boat of FIG. 3.
Figure 5:
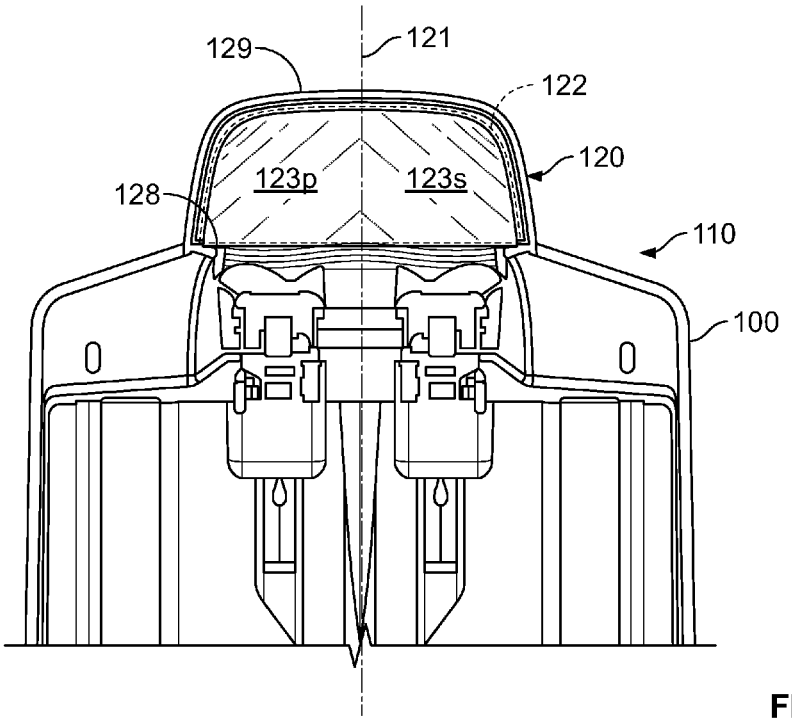
FIG. 5 is a partial bottom view of the boat of FIG. 3.

In the depicted implementation, the boat 100 includes a jet boat propulsion system 170 (e.g., refer to FIG. 4). In some implementations, the wake surfing platform 120 is well-suited for use with the jet boat propulsion system 170 (e.g., to shape the rooster tail from the jet boat propulsion system 170). Additionally, the wake surfing platform 120 can be used in conjunction with boats that have other types of propulsion systems. For example, the wake surfing platform 120 can be used with sterndrive boats, boats with one or more inboard motors, and boats equipped with one or more outboard motors.

In some implementations, the wake surfing platform 120 also includes a top deck portion 126, a boat engaging side 128, and an aft side 129. The top deck portion 126 defines an upper surface that is configured to support a human in some implementations. Hence, the total deck space of the boat 100 may be increased by the wake surfing platform 120.

The boat engaging side 128 interfaces the wake surfing platform 120 with the aft portion 110 of the boat 100. In some implementations, the wake surfing platform 120 is bolted onto the aft portion 110 of the boat 100. That is, in some implementations the boat engaging side 128 is configured for affixing (e.g., bolting, clamping, etc.) the wake surfing platform 120 to a previously existing boat 100. In some implementations, the wake surfing platform 120 is integrally formed with the aft portion 110 of the boat 100 as part of the manufacturing process of the boat 100. The aft side 129 of the wake surfing platform 120 is opposite of the boat engaging side 128. In some implementations, an axis 121 (refer to FIG. 5) bisects the wake surfing platform 120 along a direction between the boat engaging side 128 and the aft side 129.

In some implementations, the water contacting surface 122 includes a starboard-side wake-shaping surface 123*s* and a port-side wake-shaping surface 123*p*. The starboard-side wake-shaping surface 123*s* and the port-side wake-shaping surface 123*p* are configured to contact and shape the wake of the boat 100 so that the wake is well-suited for wake surfing. In some implementations, the starboard-side wake-shaping surface 123*s* and the port-side wake-shaping surface 123*p* are generally symmetric in relation to each other about the axis 121. In some implementations, the starboard-side wake-shaping surface 123*s* and the port-side wake-shaping surface 123*p* are asymmetric in relation to each other about the axis 121. In some implementations, the axis 121 need not bisect the wake surfing platform (e.g., depending on the desired wake shape, physical characteristics of the hull of the boat, or other factors (e.g., weight distribution of the boat or a wake shape created by the boat itself).

As shown in FIG. 4, in some implementations at least a portion of the water contacting surface 122 slopes downward in a direction from the boat engaging side 128 to the aft side 129 (i.e., in the direction of the axis 121). For example, in the depicted implementation at least portions of each of the starboard-side wake-shaping surface 123*s* and the port-side wake-shaping surface 123*p* slope downward in a direction from the boat engaging side 128 to the aft side 129. As described further below, in some implementations the rate of the slope differs at various positions along the axis 121 (and/or along paths that are parallel to the axis 121). For example, in some implementations the rate of slope increases in a direction from the boat engaging side 128 to the aft side 129. That is, in some implementations the aft portions of the water contacting surface 122 are more greatly sloped than the fore portions. In some implementations, the rate of the slope is generally constant along the axis 121 (and/or along paths that are parallel to the axis 121).

Figure 3:
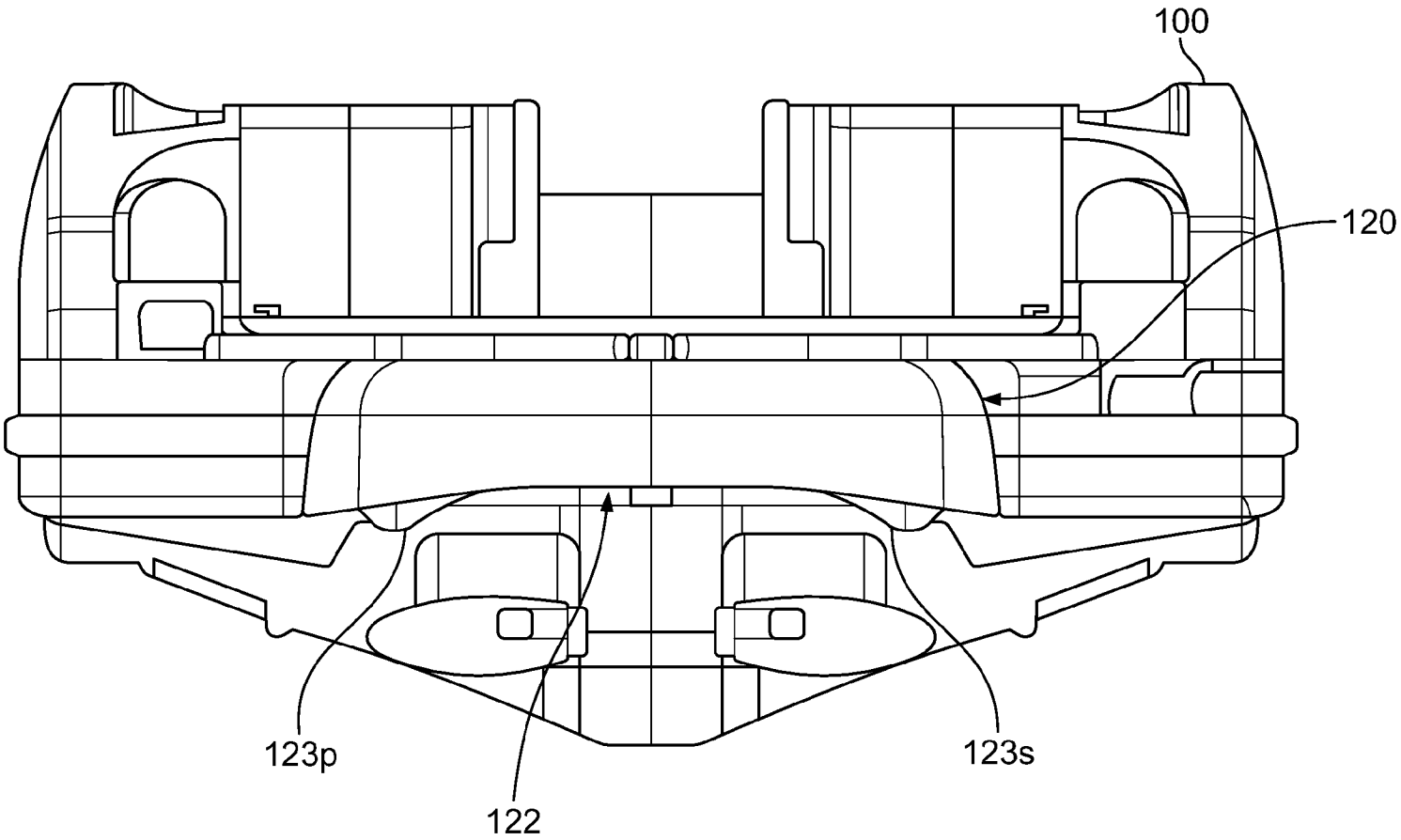
FIG. 3 is an aft end view of an example sport boat that includes a wake surfing platform in accordance with some embodiments.
Figure 6:
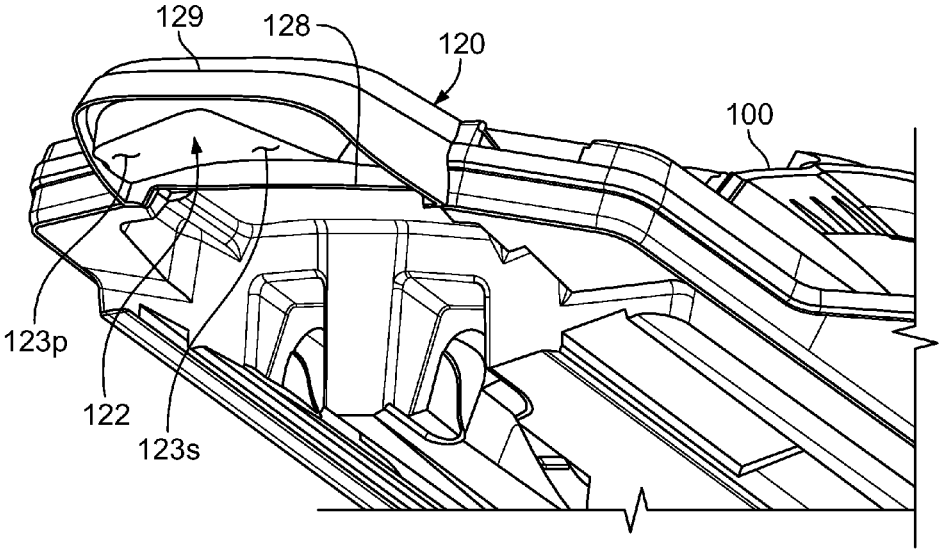
FIG. 6 is a partial perspective underside view of the boat of FIG. 3. The boat is shown without a propulsion system.
Figure 7:
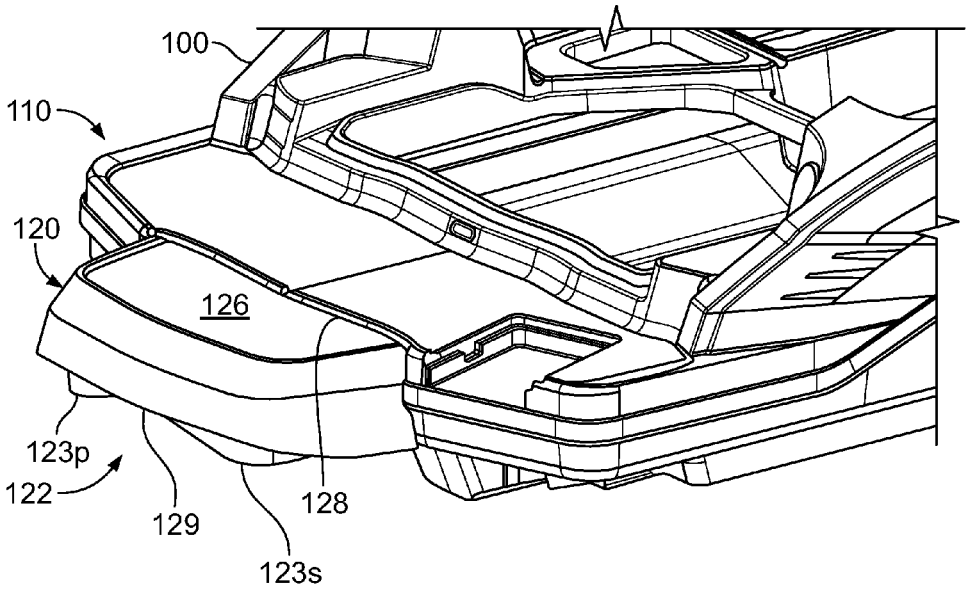
FIG. 7 is a partial perspective top view of the boat of FIG. 6.

As seen in FIGS. 3, 6, and 7, in some implementations at least a portion of the water contacting surface 122 is concaved between the starboard side and the port side of the wake surfing platform 120. For example, in the depicted implementation at least portions of the starboard-side wake-shaping surface 123*s* and the port-side wake-shaping surface 123*p* collectively define the concave shape. As described further below, in some implementations the shape and/or degree of the concavity differs at various positions along the axis 121. In some implementations, the shape of the concavity is generally constant along the axis 121.

Figure 8:
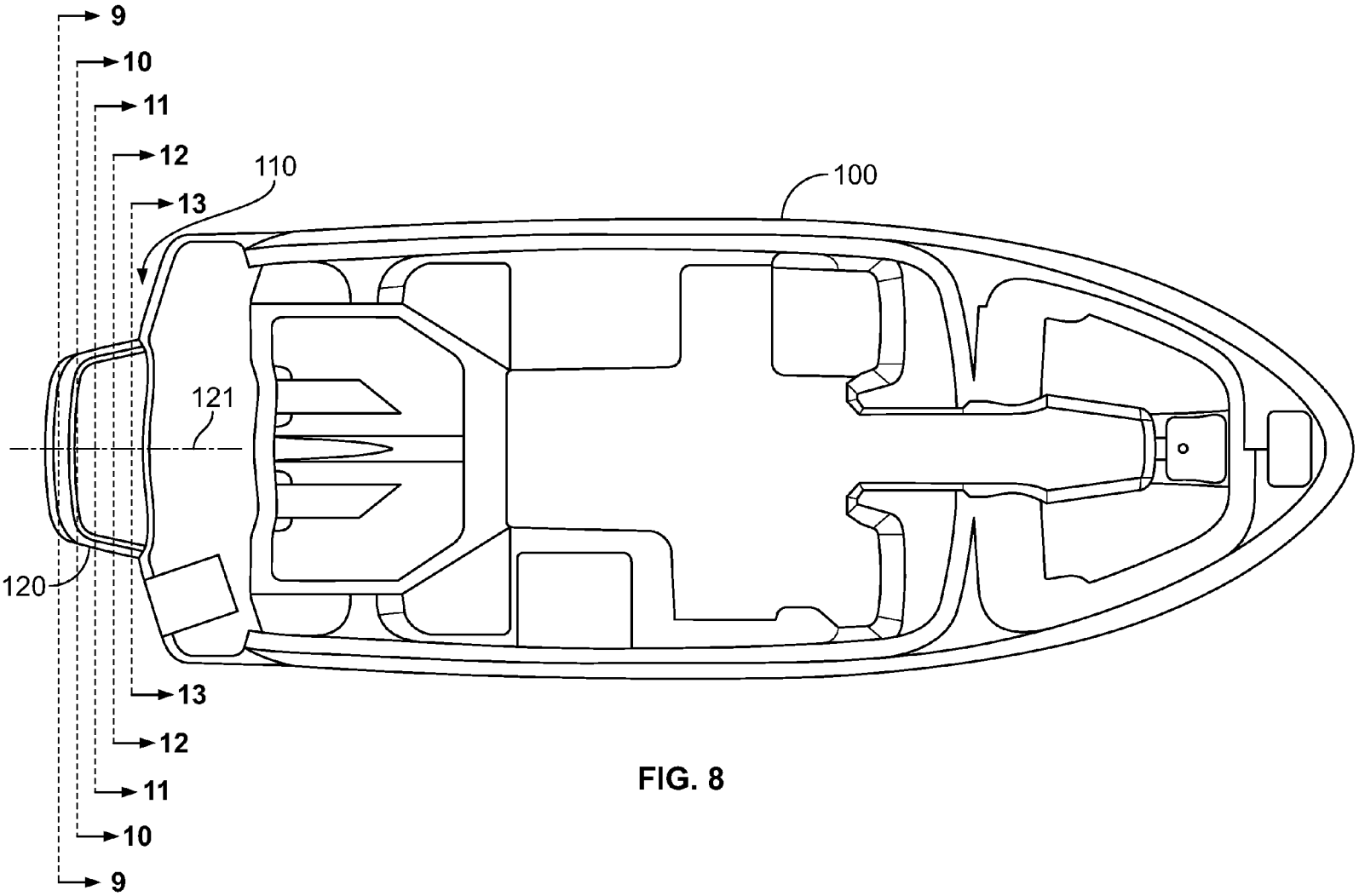
FIG. 8 is a plan view of the boat of FIG. 6.
Figure 9:
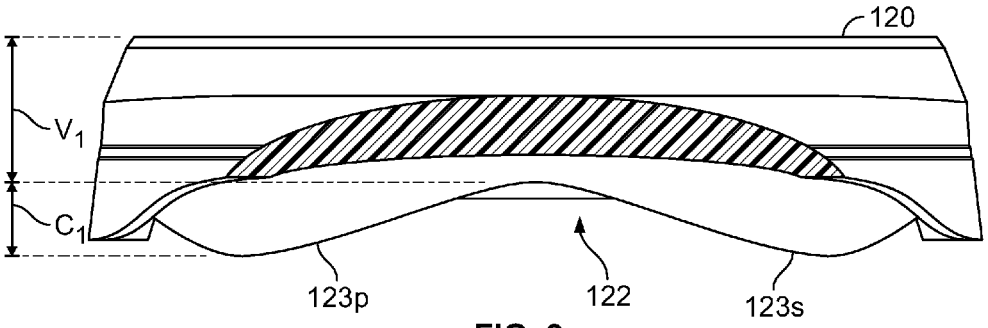
FIGS. 9-13 are a series of transverse cross-sectional views of the wake surfing platform of the boat of FIG. 8.
Figure 10:
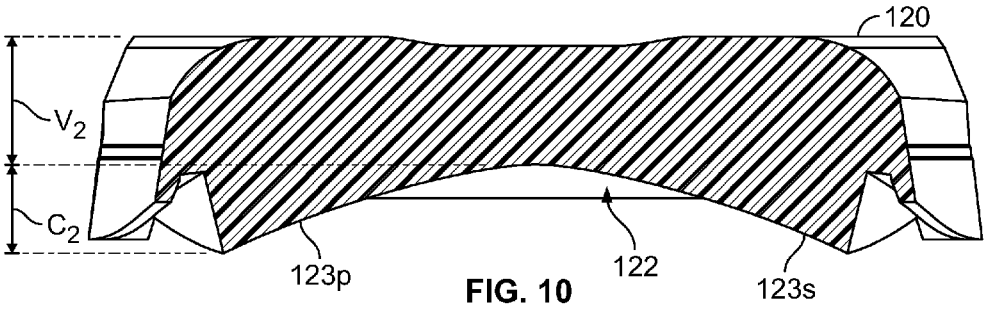
Figure 11:
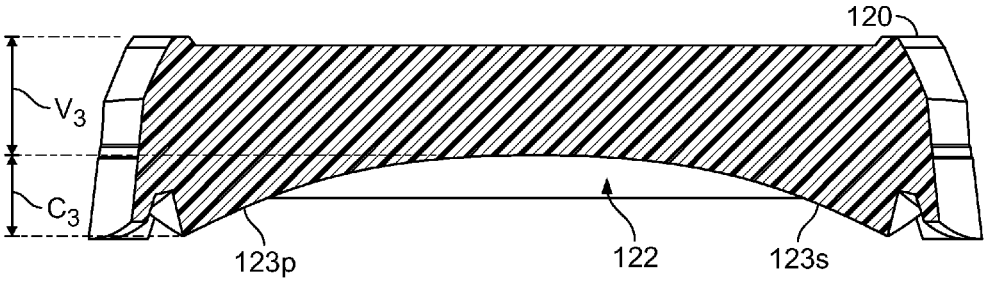
Figure 12:
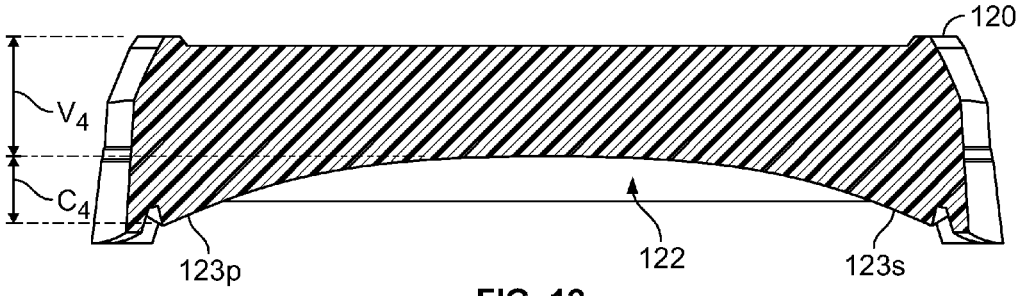
Figure 13:
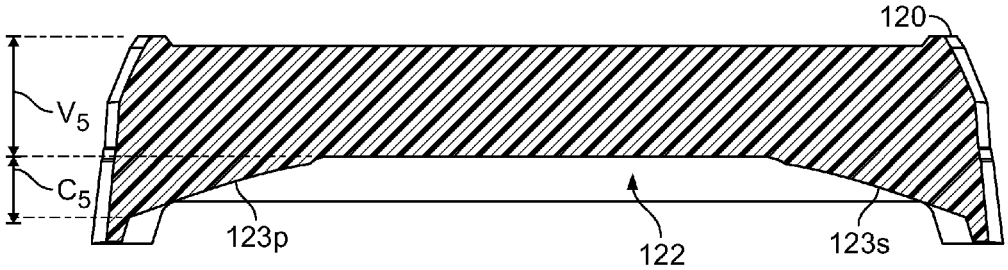

Referring to FIGS. 8-13, by viewing the wake surfing platform 120 as a series of cross-sectional views (transverse to the axis 121), the shape of the example water contacting surface 122 can be further understood. As indicated in FIG. 8, FIG. 9 is the aft-most cross-sectional view of the series, and FIG. 13 is the fore-most cross-sectional view of the series. FIGS. 10-12 are cross-sectional views taken sequentially between the locations of FIGS. 9 and 13.

It should be understood that the shape of the water contacting surface 122 as depicted in FIGS. 9-13 is merely one example of many different shapes that the water contacting surface 122 may have. That is, this description is not limiting in terms of the shape of the water contacting surface 122, and other shapes are within the scope of this disclosure.

In some implementations, the shape of the water contacting surface 122 can be selectively adjustable. For example, in some implementations one or more portions of the water contacting surface 122 can be hydraulically or electrically adjustable (e.g., pivoted to change the slope/trim, lowered or raised, etc.). Additionally, in some implementations one or more portions of the water contacting surface 122 can be manually adjusted and locked in place (e.g., by shimming, adjusting clamp mechanisms, and the like). Hence, in some implementations the shape of the water contacting surface 122 can be selectively adjusted or manipulated to attain a desired wake shape.

In the depicted implementation, the water contacting surface 122 is generally a non-planar contoured surface. In some implementations, the water contacting surface 122 is made up of one or more generally planar surfaces. In some implementations, the water contacting surface 122 is made up of a combination of one or more generally non-planar contoured surfaces and one or more generally planar surfaces.

The vertical distances from the top of the wake surfing platform 120 to the highest elevation of the water contacting surface 122 at the cross-sections of FIGS. 9-13 are identified as $V_1$, $V_2$, $V_3$, $V_4$, and $V_5$ respectively. By comparing $V_1$, $V_2$, $V_3$, $V_4$, and $V_5$ to each other, a slope of the water contacting surface 122 can be characterized. For example, in the depicted embodiment of the water contacting surface 122, $V_1 \geq V_2 \geq V_3 \geq V_4 \geq V_5$. Stated differently, at least a portion of the water contacting surface 122 slopes downward in a direction from fore to aft of the wake surfing platform 120 (i.e., referring to FIGS. 4 and 5, in a direction from the boat engaging side 128 to the aft side 129). In some implementations, generally all portions of the water contacting surface 122 slope downward in a direction from fore to aft of the wake surfing platform 120 (along paths parallel to axis 121). In some implementations, some portions of the water contacting surface 122 slope downward in a direction from fore to aft of the wake surfing platform 120 while other portions are level or slope upward in a direction from fore to aft of the wake surfing platform 120. For example, in some implementations the aft portions of the water contacting surface 122 are more greatly sloped than the fore portions which may be level or slop upward in some implementations.

It is apparent from FIGS. 9-13 that the example water contacting surface 122 is generally concaved. In some implementations, substantially all cross-sectional portions of the water contacting surface 122 are generally concaved. In some implementations, some portions of the water contacting surface 122 are concaved, while other portions are not concaved.

The vertical distances from the highest elevation of the water contacting surface 122 to the lowest elevation of the water contacting surface 122 at the cross-sections of FIGS. 9-13 are identified as $C_1$, $C_2$, $C_3$, $C_4$, and $C_5$ respectively. By comparing $C_1$, $C_2$, $C_3$, $C_4$, and $C_5$ to each other, a degree of the concavity of the water contacting surface 122 can be characterized. For example, in the depicted embodiment of the water contacting surface 122, $C_1 \geq C_2 \geq C_3 \geq C_4 \geq C_5$. Stated differently, the degree of the concavity of the water contacting surface 122 generally increases in a direction from fore to aft of the wake surfing platform 120. In some implementations, some portions of the water contacting surface 122 increase in the degree of concavity in a direction from fore to aft of the wake surfing platform 120, while other portions are constant or decrease in the degree of concavity in a direction from fore to aft of the wake surfing platform 120.

While this specification contains many specific implementation details, these should not be construed as limitations on the scope of any invention or of what may be claimed, but rather as descriptions of features that may be specific to particular embodiments of particular inventions. Certain features that are described in this specification in the context of separate embodiments can also be implemented in combination in a single embodiment. Conversely, various features that are described in the context of a single embodiment can also be implemented in multiple embodiments separately or in any suitable subcombination. Moreover, although features may be described herein as acting in certain combinations and even initially claimed as such, one or more features from a claimed combination can in some cases be excised from the combination, and the claimed combination may be directed to a subcombination or variation of a subcombination.

Similarly, while operations are depicted in the drawings in a particular order, this should not be understood as requiring that such operations be performed in the particular order shown or in sequential order, or that all illustrated operations be performed, to achieve desirable results. In certain circumstances, multitasking and parallel processing may be advantageous. Moreover, the separation of various system modules and components in the embodiments described herein should not be understood as requiring such separation in all embodiments, and it should be understood that the described program components and systems can generally be integrated together in a single product or packaged into multiple products.

Particular embodiments of the subject matter have been described. Other embodiments are within the scope of the following claims. For example, the actions recited in the claims can be performed in a different order and still achieve desirable results. As one example, the processes depicted in the accompanying figures do not necessarily require the particular order shown, or sequential order, to achieve desirable results. In certain implementations, multitasking and parallel processing may be advantageous.

What is claimed is:

1. A boat platform, comprising:

a water contacting surface having a concave shape between a port side and a starboard side of the boat platform; and a boat engaging side that is configured for connection to an aft portion of a boat behind a propulsion device of the boat such that the water contacting surface is positioned to shape water emerging from the propulsion device, wherein a vertical distance between: (i) a highest elevation of the water contacting surface and (ii) a lowest elevation of the water contacting surface increases along a direction from the boat engaging side to an opposite side of the water contacting surface.

2. The boat platform of claim 1, wherein the water contacting surface comprises a starboard-side wake-shaping surface and a port-side wake-shaping surface, and wherein the starboard-side wake-shaping surface and the port-side wake-shaping surface collectively define the concave shape.

3. The boat platform of claim 2, wherein the starboard-side wake-shaping surface and the port-side wake-shaping surface are generally symmetric in relation to each other about a vertical plane that bisects the boat platform.

4. The boat platform of claim 2, wherein the starboard-side wake-shaping surface and the port-side wake-shaping surface each comprise generally planar surfaces.

5. The boat platform of claim 2, wherein the starboard-side wake-shaping surface and the port-side wake-shaping surface each comprise generally non-planar contoured surfaces.

6. The boat platform of claim 1, wherein at least a portion of the water contacting surface slopes downward in a direction from the boat engaging side to an opposite side of the boat platform.

7. The boat platform of claim 6, wherein the water contacting surface comprises a starboard-side wake-shaping surface and a port-side wake-shaping surface, and wherein each of the starboard-side wake-shaping surface and the port-side wake-shaping surface define the downward slope of the water contacting surface.

8. The boat platform of claim 6, wherein the boat platform is configured such that a slope or elevation of the water contacting surface is selectively adjustable in relation to a hull of a boat to which the boat platform is connected.

9. The boat platform of claim 1, wherein the boat platform is configured to be bolted onto the aft portion of the boat or integrated into a hull and deck of the boat.

10. The boat platform of claim 1, wherein the boat platform is configured to be molded onto the aft portion of the boat.

11. A boat adapted to facilitate wakesurfing behind the boat, the boat comprising:

a hull; and a boat platform extending from an aft portion of the hull behind a propulsion device of the boat, the boat platform comprising a water contacting surface positioned to shape water emerging from the propulsion device, wherein at least a portion of the water contacting surface has a concave shape between a port side and a starboard side of the boat platform, and wherein a vertical distance between: (i) a highest elevation of the water contacting surface and (ii) a lowest elevation of the water contacting surface increases along a direction from the boat engaging side to an opposite side of the water contacting surface.

12. The boat of claim 11, wherein the boat platform is integrally formed with the hull.

13. The boat of claim 11, further comprising a deck attached to the hull, and wherein the boat platform is integrally formed with the deck.

14. The boat of claim 11, further comprising a deck attached to the hull, wherein the boat platform was formed separately from the hull and the deck and subsequently affixed to the aft portion of the boat.

15. The boat platform of claim 11, wherein at least a portion of the water contacting surface slopes downward in a direction from the aft portion of the hull to an opposite side of the boat platform.

16. A method of constructing a wakesurfing boat platform configured for attachment to a boat, the method comprising:

forming a water contacting surface having a concave shape between a port side and a starboard side of the boat platform; and forming a boat engaging side that is configured for attachment to an aft portion of the boat behind a propulsion device of the boat such that the water contacting surface is positioned to shape water emerging from the propulsion device, wherein a vertical distance between: (i) a highest elevation of the water contacting surface and (ii) a lowest elevation of the water contacting surface increases along a direction from the boat engaging side to an opposite side of the water contacting surface.

17. The method of claim 16, wherein the water contacting surface slopes downward in a direction from the boat engaging side to an opposite side of the boat platform.

18. The method of claim 16, further comprising forming a top deck portion configured for supporting a human.

19. The method of claim 16, wherein the boat platform is configured to be bolted onto an aft portion of the boat.

20. The method of claim 16, wherein the boat platform comprises fiberglass.

* * * * *